US006388369B1

(12) United States Patent
Lee

(10) Patent No.: US 6,388,369 B1
(45) Date of Patent: May 14, 2002

(54) TENSION MASK ASSEMBLY OF A FLAT CRT HAVING A TENSION CONTROLLING MEMBER ON A SIDE WALL OF A SUPPORT BAR

(75) Inventor: Tae-Hoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/584,097

(22) Filed: May 31, 2000

(30) Foreign Application Priority Data

Jun. 1, 1999 (KR) ..... 99-19920

(51) Int. Cl.[7] ..... H01J 29/80
(52) U.S. Cl. ..... 313/403; 313/407
(58) Field of Search ..... 313/402, 407, 313/404, 408, 405

(56) References Cited

U.S. PATENT DOCUMENTS 5,111,107 A * 5/1992 Kume et al. ..... 313/405
5,382,871 A * 1/1995 Funahashi et al. ..... 313/402

* cited by examiner

*Primary Examiner*—Michael H. Day
*Assistant Examiner*—Joseph Williams
(74) *Attorney, Agent, or Firm*—Fleshner & Kim, LLP

(57) ABSTRACT

A tension mask assembly of a flat CRT is provided. The tension mask assembly includes a tension mask, which is placed to be opposite to a phosphor screen formed at an inner surface of a panel a predetermined distance from the phosphor screen and which serves to discriminate colors of electron beam; an aperture grill, which serves as an electron beam transmitting hole and which is formed on an effective surface of the tension mask having a slot or a dot shape; a rail which is supported by applying a predetermined tension to both ends of a long side part or short side part of the tension mask; a support bar, which supports both ends of the rail by being arranged in a direction that crosses with the rail and which has a support spring and a tamper wire disposed thereon; and a tension controlling member, which has a different rate of thermal expansion from the support bar and which is placed in a longitudinal direction against a side wall of a support bar.

14 Claims, 5 Drawing Sheets

TENSION MASK ASSEMBLY OF A FLAT CRT HAVING A TENSION CONTROLLING MEMBER ON A SIDE WALL OF A SUPPORT BAR

BACKGROUND OF THE INVENTION

1. Field of the Invention

The present invention relates generally to a mask support assembly of a color CRT(Cathode Ray Tube), and more particularly to a tension aperture grill mask which is placed at the inside surface of a screen of a flat CRT and serves to discriminate colors and a tension mask assembly of the flat CRT which supports the aperture grill mask in the state where a predetermined tension is maintained.

2. Description of the Related Art

Generally, the front panel for picture display in a flat CRT is formed to be flat, the electron beam emitted from an electron gun strikes a phosphor screen formed at the inside of a screen in a predetermined pattern with executing a uniform motion, and thus the phosphor is radiated so as to embody the pictures.

A tension aperture grill mask of thin film (hereinafter, referred to as a tension mask) which maintains a predetermined distance from the phosphor screen is combined at the inner surface of the panel of the flat CRT in the state where a predetermined tension is maintained by an additional support assembly, so as to discriminate the colors of the emitted electron beam.

The flat CRT of such construction prevents the image distortion which occurs depending on the angle at which a viewer watches a television by making the curvature of the screen be flat as compared with a general CRT, and it is possible to maximize the effective visual angle to the visual angle of 180° right and left.

It also has an advantage that it can prevent the external light from being reflected to the eyes of a viewer by minimizing the reflection of the screen due to the external light and thus diminish the eye strain even if the viewer watches the television for a long time.

A description will be made on a flat CRT to which a general tension mask is applied with reference to FIGS. 1 to 3.

The outer appearance of the flat CRT is formed by a panel 2 at an inner surface of which a phosphor screen 1 is formed and a funnel 3 which is joined at the rear of the panel 2 by a frit glass.

An electron gun 5 for emitting three electron beams 6 of R, G and B is disposed in a neck portion 4 of the funnel 3, and a deflection yoke 7 is placed at one side of the neck portion 4 so as to radiate the electron beams 6 emitted from the electron gun 5 to the screen.

A tension mask 7 having an aperture grill 11 for discriminating the colors of the emitted electron beams is placed at the inner surface of the panel 2, and the tension mask 7 is supported by a support assembly 8 which is disposed with maintaining a predetermined distance from the inner surface of the panel 2. The support assembly 8 is fixed against a stud pin 9 formed at the inner surface of the panel 2 by a support spring 10.

As shown in FIG. 2, the tension mask 7 is made of a thin metal plate (about 0.1~0.2 mm), and has a vertical (or horizontal ) slot-shaped aperture grill 11 through which the electron beams pass. The edges arranged at both sides of the aperture grill 11 are stretched by the tension applied from the support assembly 8 and are welded to both rails 12 of the support assembly 8.

The support assembly 8 is composed of a rail 12 which has two long sides in a horizontal direction and an L-shaped section, and a support bar 13 which has two short sides in a vertical direction and is welded to both ends of the rail 12 so as to support the rail 12.

The support bar 13 serves to expand the rail 12 to the outside direction against the vertical direction together with the function of supporting the rail 12, and also serves to stretch and tension the tension mask 7 welded at the rail 12 when the rail 12 is expanded to the outside direction.

A plurality of damper wires 14 which cross the effective surface of the tension mask 7 in a direction which intersects the aperture grill 11 ate fixed at the support bar 13 by a wire bracket 15 in the state where the tension is applied to both ends thereof, and the damper wire 14 offsets the vibration of the tension mask 7 due to an external sound wave generated from a speaker.

The process for manufacturing the tension mask assembly comprised of the tension mask 7 and support assembly 8 of such construction will be discussed hereinafter.

As shown in FIG. 3, the tension mask 7 is welded and fixed to the rail 12 after the rail 12 is deformed by $\delta 1$ by the force F applied to both ends of the rail 12 of the support assembly 8. Thereafter, if the force F is removed, the rail 12 is deformed to the point where a restoring force maintains balance with a resistance of the tension mask 7, i.e., by $\delta 3$ to an outside direction. Consequentially, the rail 12 is deformed by $\delta 2$ as compared with an original state and this state is maintained.

The deformation amounts by the position of the rail 12 generated in this process are shown in FIGS. 4 and 5. The CRT of 76 cm (diagonal line of the screen) is taken as an example for these deformation amounts.

As shown in FIG. 5, the deformation amount ($\delta 2$) of the rail 12 maintains balance with the force of the tension mask 7 in the state where the rail 12 is deformed by 12.7 mm from the central portion and by 2.1 mm from the end portion. That is, the central portion has greater deformation amount than the peripheral portion by 6 times and the deformation amount becomes decreased from the central portion to the peripheral portion. The reason why such a phenomenon occurs is that the peripheral portion of the rail 12 is directly welded to the support bar 13 to apply the expansion force to the rail 12, while the central portion of the rail 12 is deformed by the expansion force applied from the support bar 13 and the resistance of the tension mask 7.

FIGS. 6 and 7 show the tension and the deformation amount applied to the tension mask 7 by the expansion force of the rail 12.

FIG. 6 shows the tension by the position applied to the tension mask 7 in the state where the tension mask 7 maintains balance with the rail 12. This shows that the tension is increased from the central portion to the peripheral portion and is remarkably increased at the end of the peripheral portion where the support bar 13 is placed.

FIG. 7 shows the deformation amount of the tension mask 7 by the tension as described above. As is apparent from the figure, the tension mask 7 is deformed in proportional to the tension and the deformation amount at the peripheral portion is comparatively great.

When the deformation amount (about 0.15%) at a yield point of the material for a general tension mask 7 is set as a basis, the central portion of the tension mask 7 is below the yield point, i.e., in the elastic deformation state, and the peripheral portion exceeds the yield point and is maintained in the plastic deformation state.

The combining structure of the tension mask 7 and support assembly 8 as described above is processed by several heat treatments (about 400~450° C.) in a high temperature furnace in the process of manufacturing the CRT. As the rail 12 and the support bar 13 are thermally expanded in this process, the expansion force is increased in a vertical direction of the rail 12 and thereby the tension applied to the tension mask 7 is increased. The peripheral portion of the tension mask 7 which is maintained in the plastic deformation state is applied with the increased tension. Thereby, the break of the aperture grill 11 or the permanent plastic deformation may occur and this causes the drooping of the peripheral grill when the peripheral portion returns to a normal temperature after the heat treatments.

If there occurs the drooping of the grill as described above, there is generated a difference between the inherent vibration frequencies by the portion due to the difference of the tension between the central portion arid the peripheral portion of the tension mask 7. Therefore, if the tension mask 7 resonates by the sound wave or shock provided from an external during the operation, the position between the aperture grill 11 and the phosphor screen 1 is comparatively displaced and thereby the striking position of the electron beam is displaced, which causes a howling, i.e., a color purity deterioration phenomenon due to the stains on the picture.

To solve these problems, Japanese Patent No. 1990-276137 proposes a method of welding and fixing a resilient support assembly 17*b* which has a higher rate of thermal expansion than a support bar 13*b* at a lower flange part of the support bar 13*b* as shown in FIG. 8. If the heat treatment is processed as described above, the support assembly 17*b* is contracted to the inner side and thus the increase of the tension applied to the tension mask 7*b* via the rail 12*b* is suppressed, thereby preventing the damage of the aperture grill 11*b*.

However, the above method has a problem of increasing the number of components and the manufacturing costs, since a private resilient support assembly 17*b* should be placed so as to prevent the damage of the aperture grill 11*b*.

That is, in the above technique, the support spring should be fixed to the support bar via another means, i.e., a spring bracket 16 when the support spring 10 for fixing the support assembly 8 to the panel stud pin 9 is fixed to the support bar 13 as described above with reference to FIGS. 1 to 2.

Moreover, the wire bracket 15 which applies the tension to the damper wire 14 also requires an additional support assembly 16', thereby increasing the number of components.

SUMMARY OF THE INVENTION

It is therefore, an object of the present invention to provide a tension mask assembly of a flat CRT which can simplify the construction of an assembly for supporting a tension mask in the state where a predetermined tension is maintained and prevent the path of electron beams from breaking away by isolating the permanent plastic deformation of a grill due to a thermal expansion.

It is another object of the present invention to provide a tension mask assembly of a flat CRT which can decrease the number of components and processes by simplifying the construction of a support assembly for supporting a tension mask, down the ghost according thereto and improve the color purity of the CRT by preventing a howling due to an external vibration.

To achieve the above objects, the tension mask assembly of a flat CRT comprises a tension mask which is placed to be opposite to a phosphor screen formed at an inner surface of a panel with maintaining a predetermined distance from the phosphor screen and serves to discriminate the colors of electron beams; an aperture grill which serves as an electron beam transmitting hole and is formed on an effective surface of the tension mask to have a slot or dot shape a rail which is supported with applying a predetermined tension to both ends of a long side part or a short side part of the tension mask; a support bar which supports both ends of the rail by being arranged in a direction that crosses with the rail and has a support spring and a damper wire disposed thereon; and a tension controlling member which has a different rate of thermal expansion from the support bar and is placed in a longitudinal direction against the side wall of the support bar.

According to a first embodiment of the present invention, it is preferred that the tension controlling member is made of the material which has a higher rate of thermal expansion than the support bar.

According to a second embodiment of the present invention, it is preferred that the tension controlling member is made of the material which has a lower rate of thermal expansion than the support bar and is combined at an inside wall of the support bar.

According to a third embodiment of the present invention, it is preferred that a spring fixing part and a bracket fixing part for fixing the support spring and the damper wire are incorporated at an inside or outside of the tension controlling member.

According to a fourth embodiment of the present invention, it is preferred that the tension controlling member is placed at the longitudinal direction of the support bar with the central portion thereof maintaining a regular position with the central portion of the support bar.

If the mask assembly is heat-treated several times at the inside of a high temperature furnace in the process of manufacturing a CRT, the rail and the support bar become thermally expanded. In this case, even though the rate of expansion of the rail becomes increased, the support bar is bent to an inner direction by the tension controlling member of the present invention which has a different rate of thermal expansion and thereby the tension applied to the tension mask when the rail is contracted is not increased.

Consequentially, it is possible to prevent the grill break or permanent plastic deformation of the tension mask and the deterioration of the color purity due to the breaking away of the electron beam.

Furthermore, it is possible to improve the vibration characteristic of the tension mask and reduce the manufacturing costs by lowering the number of components and manufacturing processes.

A plurality of embodiments of the present invention can be proposed, however, a description will be made hereinafter only on the most preferable embodiment of the present invention.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
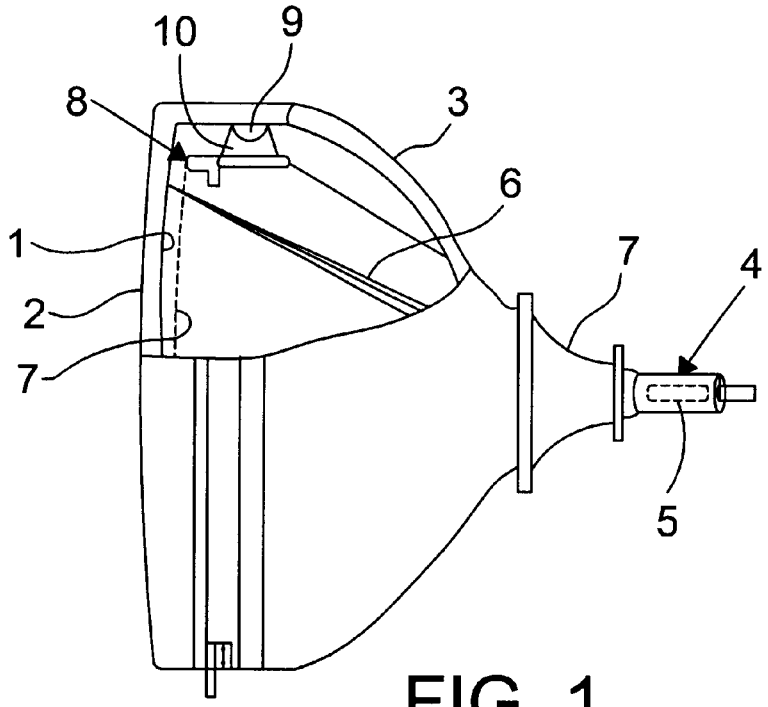
FIG. 1 PRIOR ART
FIG. 1 is a partial cross sectional view showing a general flat CRT.
Figure 2:
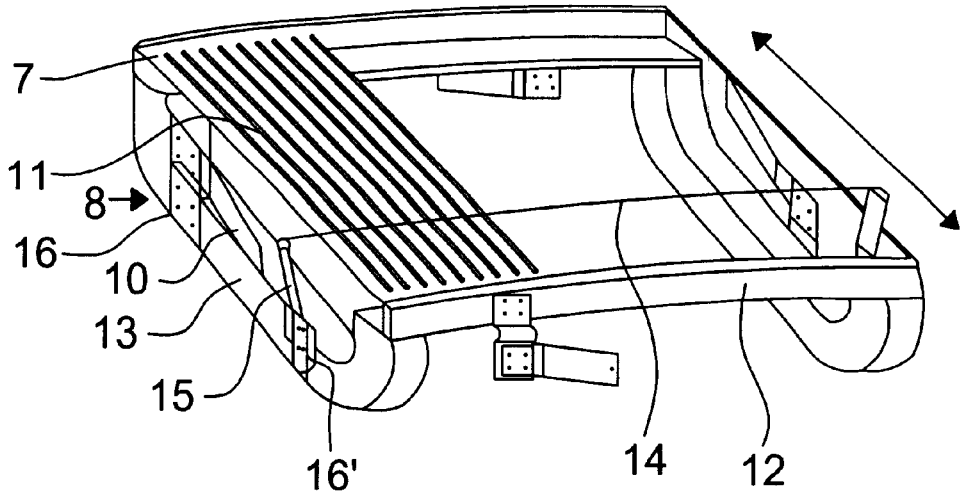
FIG. 2 PRIOR ART
FIG. 2 is a perspective view showing a tension mask assembly according to a prior art.
Figure 3:
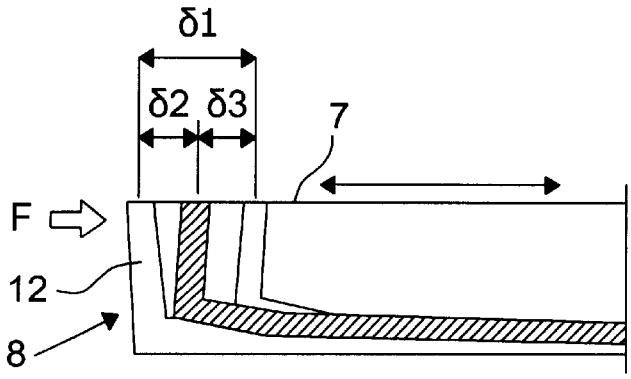
FIG. 3 PRIOR ART
FIG. 3 is a view showing a deformation of a tension mask assembly.
Figure 4:
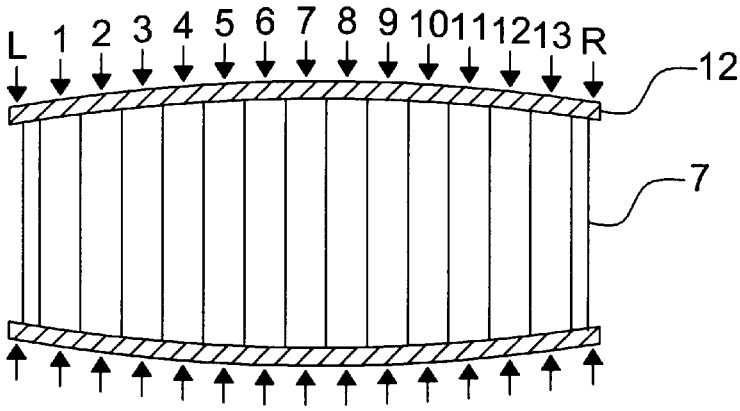
FIG. 4 PRIOR ART
FIG. 4 is a view showing the position where the deformation amount of a rail is measured.
Figure 5:
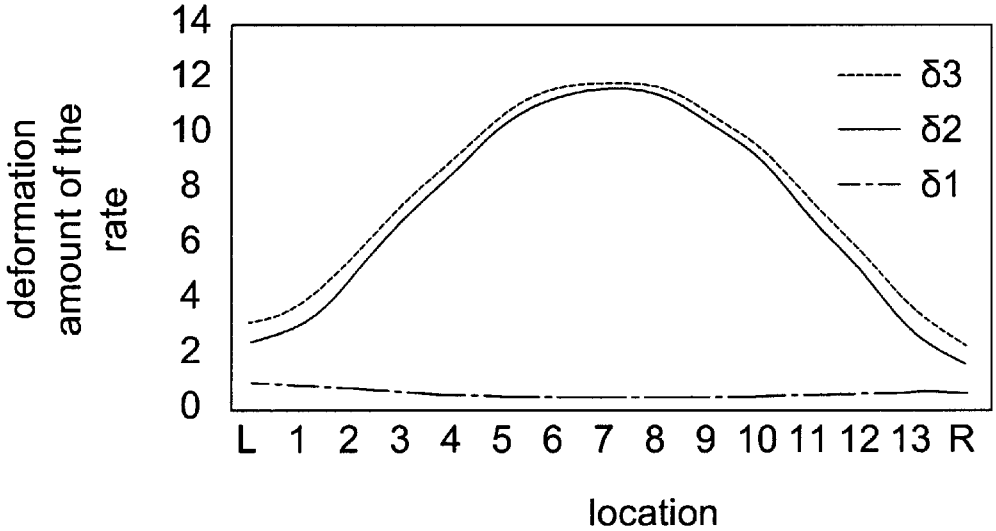
FIG. 5 PRIOR ART
FIG. 5 is a view showing the deformation amount by the position of the rail according to a prior art.
Figure 6:
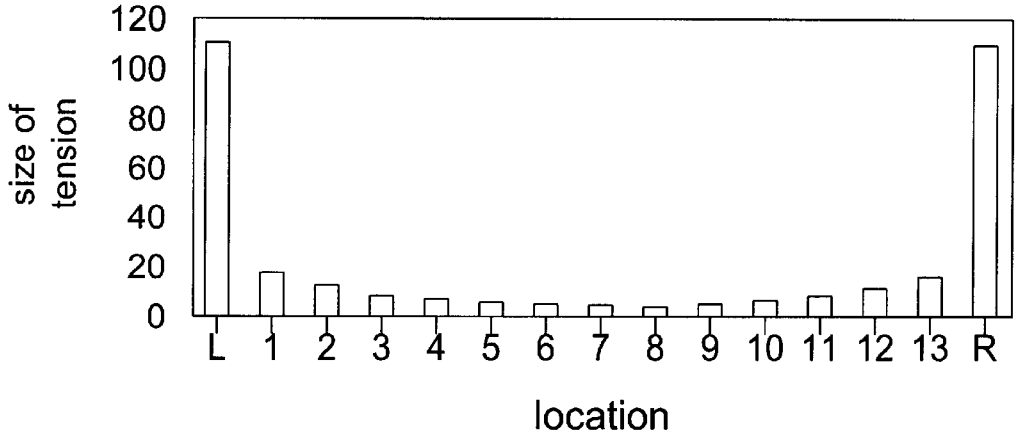
FIG. 6 PRIOR ART
FIG. 6 is a diagram showing the size of the tension by the position applied to the tension mask according to a prior art.
Figure 7:
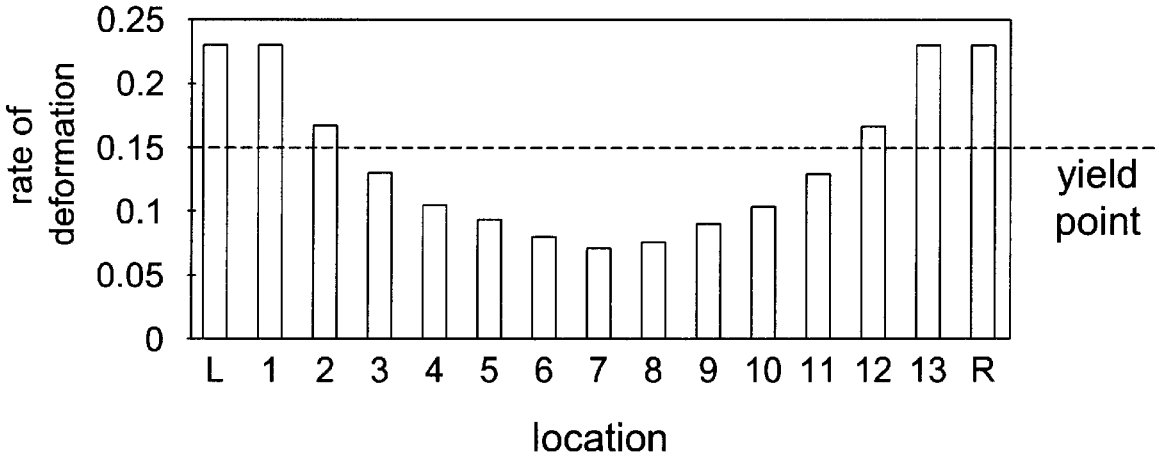
FIG. 7 PRIOR ART
FIG. 7 is a diagram showing the rate of deformation by the position of the tension mask according to a prior art.
Figure 8A:
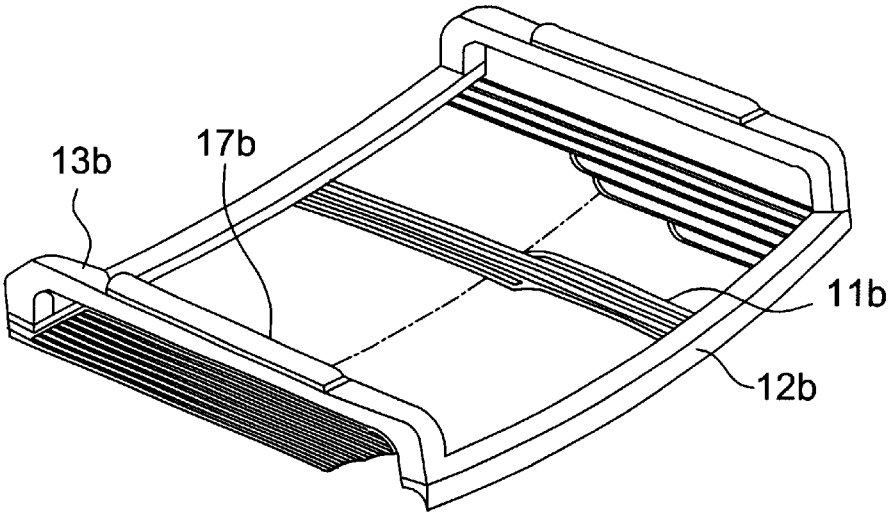
FIG. 8A PRIOR ART
FIG. 8A is a perspective view showing a mask assembly according to a prior art.
Figure 8B:
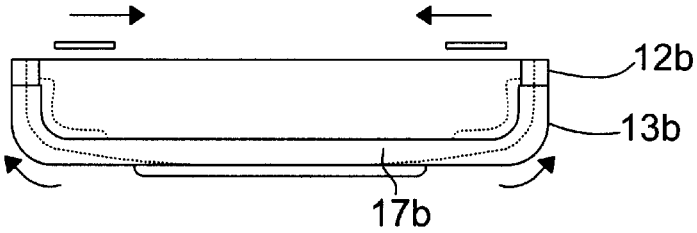
FIG. 8B PRIOR ART
FIG. 8B is a cross sectional view showing the mask assembly according to a prior art.

A preferred embodiment of a tension mask assembly (support assembly) of the present invention will be described with reference to the accompanying drawings. Throughout the drawings, it is noted that the same reference numerals of letter will be used to designate like or equivalent elements having the same function.

Figure 9:
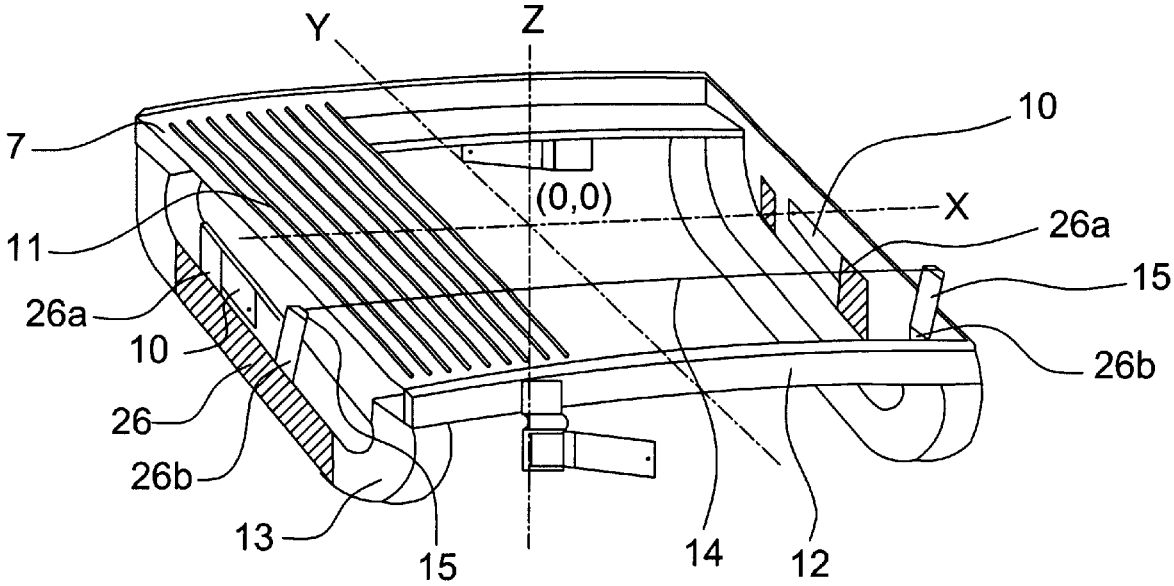
FIG. 9 is a perspective view showing a tension mask assembly according to a preferred embodiment of the present invention.
Figure 10:
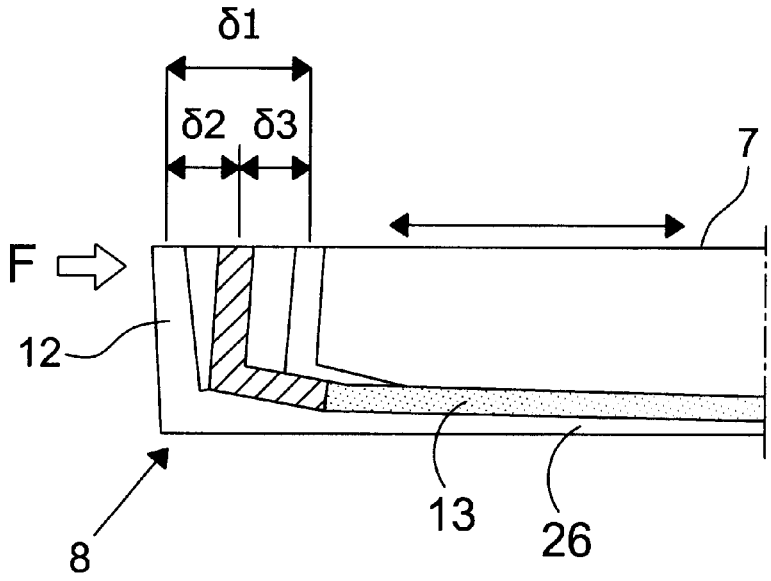
FIG. 10 is a view showing the position where the deformation amount of a rail is measured.
Figure 11:
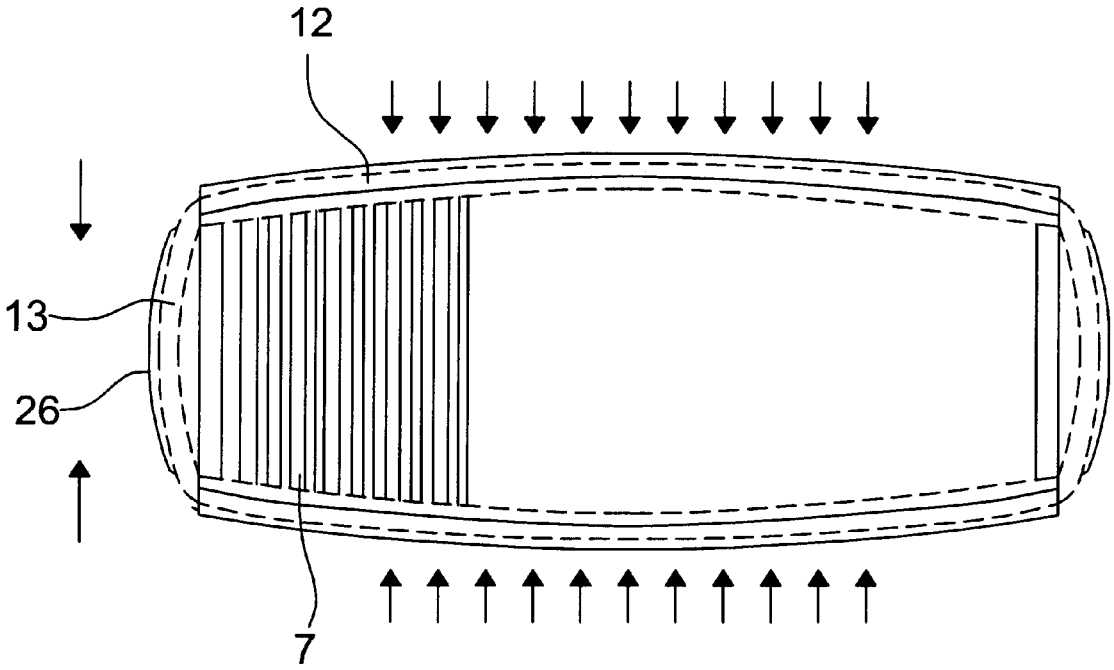
FIG. 11 is a view showing an operation of the assembly according to the present invention.

FIG. 1 is a cross sectional view showing a construction of a general flat CRT to which the present invention is applied, FIG. 9 is a perspective view showing a support assembly according to a preferred embodiment of the present invention, FIG. 10 is a diagram showing a mechanism for applying a tension to a tension mask assembly according to the present invention, and FIG. 11 is a view showing an operation of the assembly of the present invention.

The schematic construction of the support assembly 8 according to the present invention is substantially similar to that described in a prior art except that a tension controlling member 26 is welded at a circumference of a support bar 13 in a direction parallel to the support bar.

The tension controlling member 26 is made of the material which has a higher rate of thermal expansion than the support bar 13.

A support spring 10 is welded to the tension controlling member 26 and it is projected from the side of the tension mask 7 of the tension controlling member 26 in a perpendicular direction.

The tension controlling member 26 has a spring fixing part 26*a* and a bracket fixing part 26*b* which is extended around the edge of the tension controlling member 26, i.e., in the same direction as the projection direction of the spring fixing part 26*a*. The spring fixing part 26*a* and the bracket fixing part 26*b* are incorporated in the tension controlling member 26.

A wire bracket 15 for supporting a damper wire 14 is welded to the bracket fixing part 26*b*.

That is, support spring 10 for fixing the support assembly 8 to a stud pin 9 formed at the inner surface of the panel 2 is welded at the outer surface of the spring fixing part 26*b*, and a wire bracket 15 for applying the tension to the damper wire 14 is welded at the outer surface of the bracket fixing part 26*b*.

The reason why the spring fixing part 26*a* and the bracket fixing part 26*b* are incorporated in the tension controlling member 26 and the support spring 10 and the wire bracket 15 are welded at respective circumferential walls is that the stud pins 9 formed at the inside wall of the long side or short side of the panel 2 to which the support assembly 8 is fixed are parallel to a mechanical center (0,0) of the panel 2 or support assembly 8 and are placed on a plane spaced by a predetermined distance in the direction of Z axis.

Therefore, the support spring 10 combined to the stud pin 9 should be disposed on the plane where the stud pin 9 is placed. However, since the rail 12 and support bar 13 of the support assembly 8 have different shape and there exists a predetermined pitch from the mechanical center (0,0), in order to place the support spring 10 on the same plane as the stud pin 9, there is required an auxiliary supporting device at several places of the long/short sides so as to adjust the pitch to the plane where the support spring 10 is to be placed. Hence, the spring fixing part 26*a* and the bracket fixing part 26*b* can achieve the above object.

In the meanwhile, the tension controlling member 26 functions to prevent the break of the grill due to the excessive application of the tension to the aperture grill 11 at a high temperature of about 450° C., and a detailed description thereon will be discussed hereinafter.

Since the tension controlling member 26 can satisfy the function of preventing the grill break and the function of the spring fixing part 26*a* and bracket fixing part 26*b* at the same time, it is possible to reduce the number of required components. That is, the present invention requires only one component, while the prior art requires three components on the basis of one surface of the short side of the support assembly 8.

That is, in a prior art, a tension controlling member which serves to prevent the grill break and is placed at a lower end of the support bar, one bracket structure for supporting the support spring and one bracket structure for supporting the damper wire are required, and these three components are independently placed.

In the process of manufacturing the support assembly 8 of such construction according to the present invention, the tension mask 7 receives the expansion force generated by the bending stress to a rectangular direction against the longitudinal direction of the support bar 13 of the frame assembly 8 via the rail 12 fixed to the support bar 13, and thereby the aperture grill 11 of the tension mask 7 is stretched.

That is, as shown in FIG. 10, the force F is applied to both ends of the rail 12 of the support assembly 8 so as to deform the rail 12 by $\delta 1$ and then the tension mask 7 is welded to the rail 12. Thereafter, if the force F is removed, the rail 12 is deformed to the point where the restoring force maintains balance with the resistance of the tension mask 7, i.e., by $\delta 3$ to the outside direction, and consequentially, the rail 12 is deformed by $\delta 2$ as compared with the original state and this state is maintained.

Here, the force F applied to both ends of the rail 12 is set such that the deformation amount of the aperture grill 11 at the peripheral portion of the tension mask 7 after welding the tension mask 7 to the support assembly 8 is below the yield point, i.e., the elastic deformation section of the material.

That is, if the material which has a deformation rate of 0.15% at the yield point of the above material is applied to the tension mask 7, the force F is set such that the deformation rate becomes below 0.15% at the peripheral portion of the tension mask 7.

In a prior art, the force F is set to be excessive so as to assure the tensile strength at the central portion of the tension mask 7, and thereby the deformation amount at the peripheral portion of the tension mask 7 exceeds the yield point of the material, causing the plastic deformation. In the present invention, the force F is set as described above so as to solve this problem.

Meanwhile, when the tension mask 7 and the support assembly 8 are heat-treated several times at a high temperature (about 400~450° C.) in the manufacturing process of the CRT, the rail 12 and the support bar 13 are thermally expanded and the expansion force of the rail 12 to a vertical direction is increased, thereby increasing the tension applied to the tension mask 7.

In this case, the tension controlling member 26 formed at an outside wall of the support bar 13 is thermally expanded as indicated by a dotted line in FIG. 11. Since the rate of thermal expansion of the tension controlling member 26 is greater than that of the support bar 13, the support bar 13 is bent toward inside.

Therefore, the rail 12 supported by the support bar 13 is contracted toward inside of the short axis direction, and since the tension applied to the tension mask 7 supported by the rail 12 is not increased, the grill break and permanent plastic deformation of the tension mask 7 can be prevented.

Meanwhile, in the case where the rail 12 is made of for example, the material of SCM415 which has a thermal expansion coefficient of $1.2\times10^{-5}$ mm/° C., it is preferred that the tension controlling member 26 is made of the material which has a thermal expansion coefficient of $2.0\times10^{-5}$ mm/° C. which is about the twice of the thermal expansion coefficient of the rail 12.

According to another preferred embodiment of the present invention, the tension controlling member 26 may be made of the material which has a lower rate of expansion than the support bar 13 and then be welded and fixed to the inner side wall of the support bar.

In this case, it is possible to easily ensure the place for forming the support spring and to improve the process operation efficiency by assuring enough space between the rail and the inner surface of the panel skirt.

As described above, the present invention can maintain the color purity of the picture by preventing the dropping of the grill due to the break or excessive plastic deformation of the aperture grill which may occur during several heat treatments in the manufacturing process of the CRT and improve the color purity by solving the problem of a howling due to the vibration of the aperture grill by an external vibration.

Furthermore, the wire bracket for supporting a damper wire for suppressing the vibration of the aperture grill and the support bracket for fixing the support member and mask spring can be replaced by the tension controlling member, thereby enabling the reduction on costs and the simplification of process by diminishing the number of components.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A tension mask assembly of a flat CRT, comprising:

a tension mask, which is placed to be opposite to a phosphor screen formed at an inner surface of a panel maintaining a predetermined distance from said phosphor screen and which serves to discriminate the color of electron beams;

the tension mask, which serves as an electron beam transmitting hole and which is formed at an effective surface of said tension mask having a slot or dot shape;

a rail, which is supported by applying a predetermined tension to both ends of a long side part or short side part of said tension mask;

a support bar having a top wall disposed adjacent to said tension mask, a bottom wall disposed opposite to said tension mask, and side walls, which supports both ends of said rail by being arranged in a direction that crosses with said rail, and a tension controlling member, which has a different rate of thermal expansion from said support bar and which is placed in a longitudinal direction against one of the side walls of said support bar.

2. The tension mask assembly as claimed in claim 1, wherein said tension controlling member is made of a material which has a higher rate of thermal expansion than said support bar and is combined at an outlet side wall of said support bar.

3. The tension mask assembly as claimed in claim 1, wherein a spring fixing part for fixing said support spring and a bracket fixing part for fixing said damper wire are incorporated at an inner surface or an outer surface of said tension controlling member.

4. The tension mask assembly as claimed in claim 1 wherein said tension controlling member is placed at a longitudinal direction of said support bar with the central portion thereof maintaining a regular position with the central portion of said support bar.

5. The tension mask assembly as claimed in claim 1, wherein the coefficient of thermal expansion of said support bar is $1.2\times10^{-5}$ mm/° C. and the coefficient of thermal expansion of said tension controlling member is $2.0\times10^{-5}$ mm/° C.

6. The tension mask assembly as claimed in claim 1, wherein the support bar includes a support spring and a damper wire disposed thereon.

7. A tension mask assembly of a flat CRT, comprising:

a tension mask, which is disposed opposite to a phosphor screen formed at an inner surface of a panel at a predetermined distance from the phosphor screen, and which serves to discriminate a color of electron beams;

the tension mask having an aperture grill, which serves as an electron beam transmitting hole and which is formed on an effective surface of the tension mask having a slot or dot shape;

a tail, which is supported by the application of a predetermined tension to side ends of long sides or short sides of the tension mask;

a support bar having a top wall disposed adjacent to said tension mask, a bottom wall disposed opposite to said tension mask, and side walls, which support both ends of the rail, arranged so as to cross the rail; and a tension controlling member having a different rate of thermal expansion than the support bar, wherein the tension controlling member is arranged against one of the side walls of the support bar.

8. The tension mask assembly as claimed in claim 7, wherein the support bar includes a support spring and a damper wire disposed thereon.

9. The tension mask assembly as claimed in claim 8, wherein a spring fixing part for fixing the support spring and a bracket fixing part for fixing the damper wire are incorporated into an inner surface or an outer surface of the tension controlling member.

10. The tension mask assembly as claimed in claim 7, wherein the tension controlling member is arranged against one of the side walls of the support bar and extends in a longitudinal direction.

11. The tension mask assembly as claimed in claim 10, wherein the tension controlling member extends in a longitudinal direction of the support bar with a central portion thereof maintaining its position with respect to a central portion of the support bar.

12. The tension mask assembly as claimed in claim 7, wherein the tension controlling member is made of a material having a higher rate of thermal expansion than the support bar, and wherein the tension controlling member is arranged against an outer side wall of the support bar.

13. The tension mask assembly as claimed in claim 7, wherein a coefficient of thermal expansion of the support bar is $1.2\times10^{-5}$ mm/° C. and a coefficient of thermal expansion of the tension controlling member is $2.0\times10^{-5}$ mm/° C.

14. A tension mask assembly of a flat CRT, comprising:

a tension mask, which is disposed opposite to a phosphor screen formed at an inner surface of a panel at a predetermined distance from the phosphor screen, and which serves to discriminate a color of electron beams;

the tension mask having an aperture grill, which serves as an electron beam transmitting hole formed on a surface of the tension mask;

a tail, which is supported by the application of a predetermined tension to side ends of long sides or short sides of the tension mask;

a support bar having a top wall disposed adjacent to said tension mask, a bottom wall disposed opposite to said tension mask, and side walls, which supports both ends of the rail, arranged so as to cross the rail; and a tension controlling member having a different rate of thermal expansion than the support bar, wherein the tension controlling member is arranged against one of the side walls of the support bar.

* * * * *